United States Patent [19]

Rapson

[11] 4,224,985

[45] Sep. 30, 1980

[54] CONTAINMENT OF PRESSURIZED FLUID JETS

[76] Inventor: John E. Rapson, "Chinook", Nash Rd., Dibden Purliev, Southampton, Hampshire, England

[21] Appl. No.: 907,237

[22] Filed: May 18, 1978

[30] Foreign Application Priority Data

May 21, 1977 [GB] United Kingdom ..... 21522/77
Apr. 12, 1978 [GB] United Kingdom ..... 14290/78

[51] Int. Cl.[2] ..... E21B 35/00

[52] U.S. Cl. ..... 166/57; 166/75 R; 166/90; 137/842; 175/207

[58] Field of Search ..... 166/57, 90, 75; 175/25, 175/38, 65, 67, 206, 207, 208, 7; 137/806, 842; 251/1 R; 222/195, 216; 366/101, 167

[56] References Cited

U.S. PATENT DOCUMENTS

| | | | |
|---|---|---|---|
| 2,941,783 | 6/1960 | Stinson | 175/66 |
| 3,463,227 | 8/1969 | Smith | 166/90 |
| 3,608,653 | 9/1971 | Rehm | 175/25 |
| 3,653,639 | 4/1972 | Mueller | 366/167 |
| 3,819,157 | 6/1974 | Markfelt | 366/101 |
| 3,826,474 | 7/1974 | Pareja | 366/167 |
| 4,094,643 | 6/1978 | Cook et al. | 366/167 |
| 4,100,614 | 7/1978 | Mandt | 366/167 |

FOREIGN PATENT DOCUMENTS

| | | | |
|---|---|---|---|
| 45237 | of 1910 | Austria | 251/1 R |
| 208335 | of 1907 | Fed. Rep. of Germany | 175/67 |

*Primary Examiner*—James A. Leppink
*Attorney, Agent, or Firm*—Steele, Gould & Fried

[57] ABSTRACT

Apparatus for containing a pressurized fluid jet, for example a "blow-out" of oil, comprises a receptacle of preferably frusto-conical form for holding a body of liquid such as water, and means whereby the jet can enter the receptacle, the arrangement being such that, with the body of liquid in the receptacle, sufficient energy is absorbed by movement of liquid to contain the jet. The energy may be absorbed by creation of vortices, and wall parts of the receptacle, when viewed in side elevation, preferably define an included angle of less than 25°. The apparatus may be used as part of an oil-production installation on an oil-rig.

18 Claims, 17 Drawing Figures

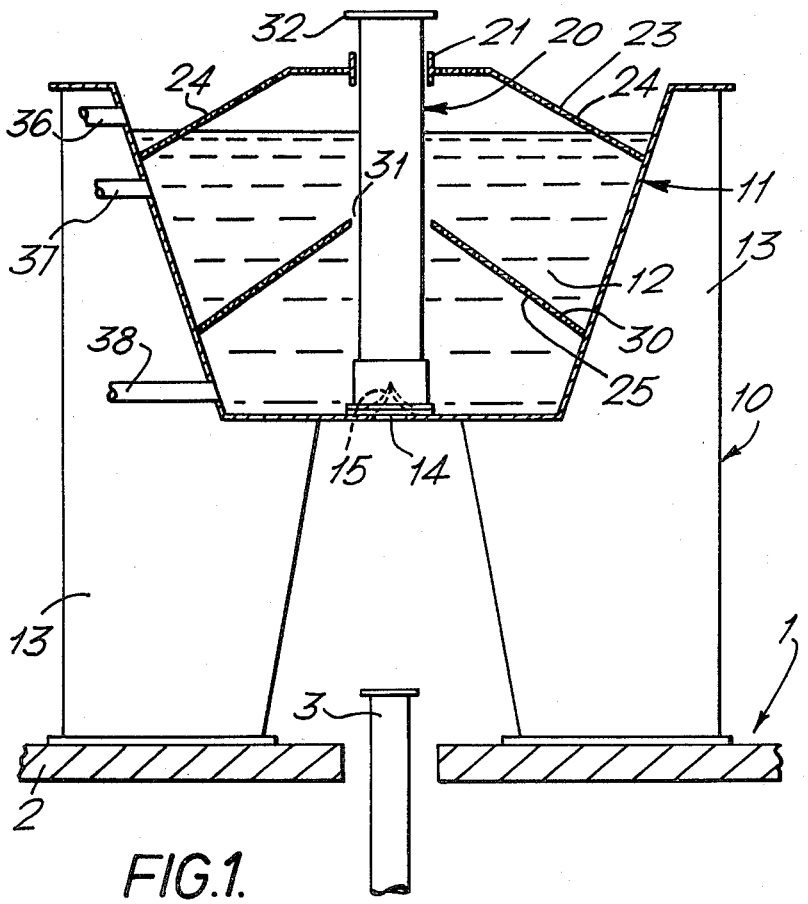
FIG.1.
FIG.2.
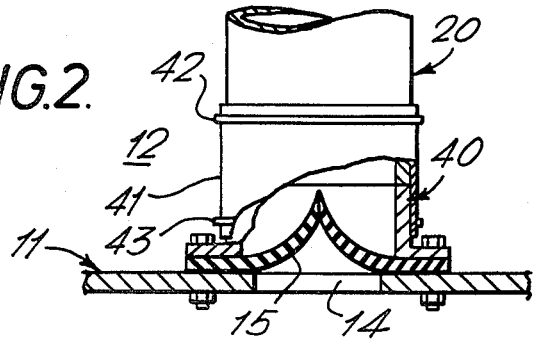

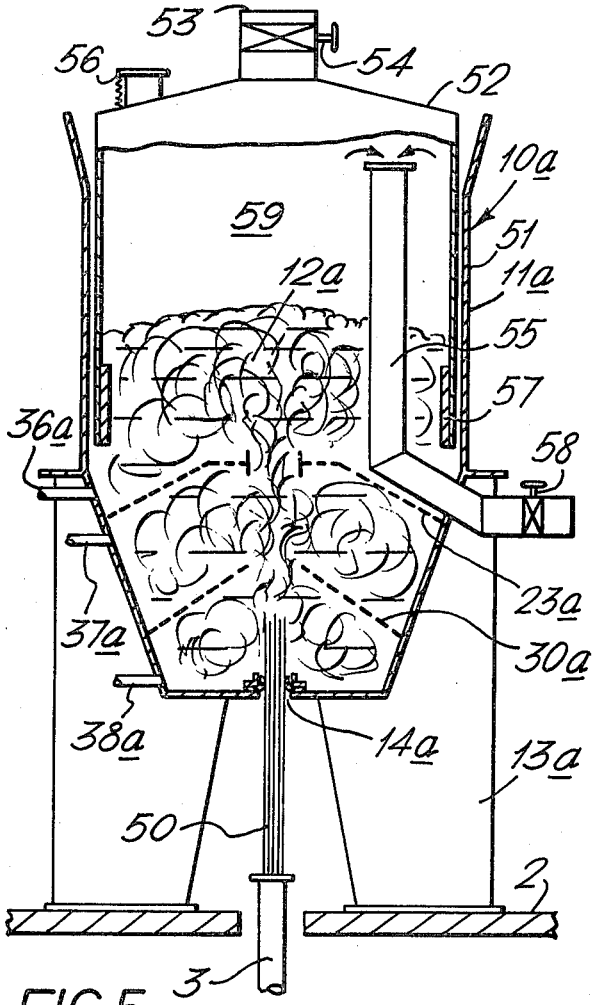
FIG.5.
FIG.6.
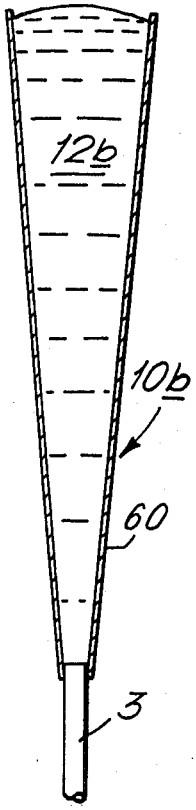
FIG.10.
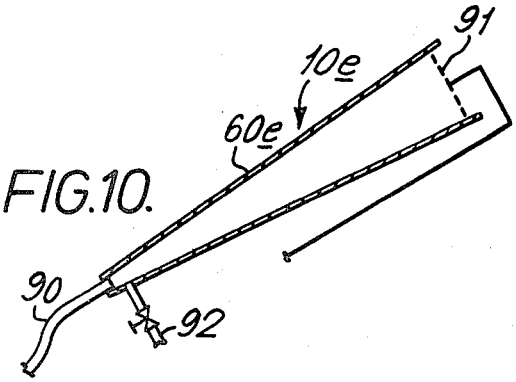
FIG.11.
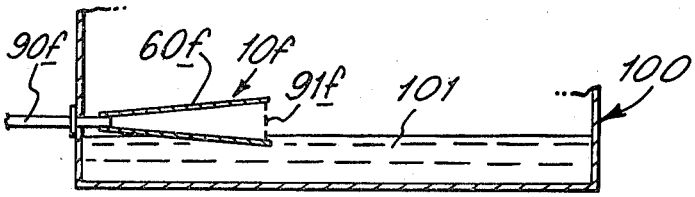

FIG.14.
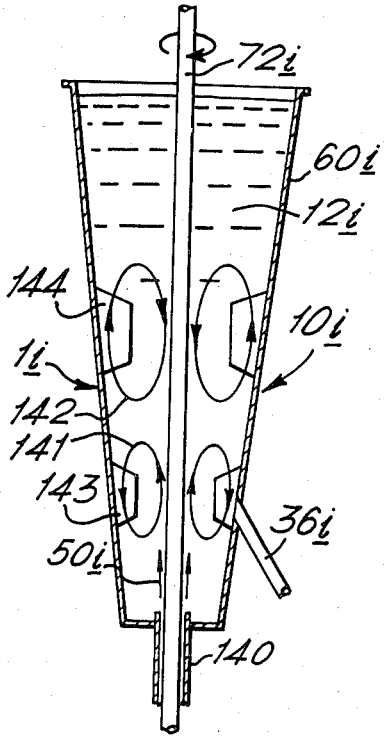
FIG.16.
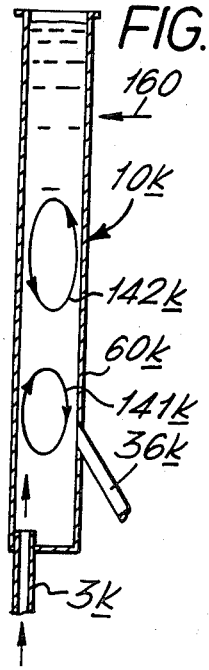
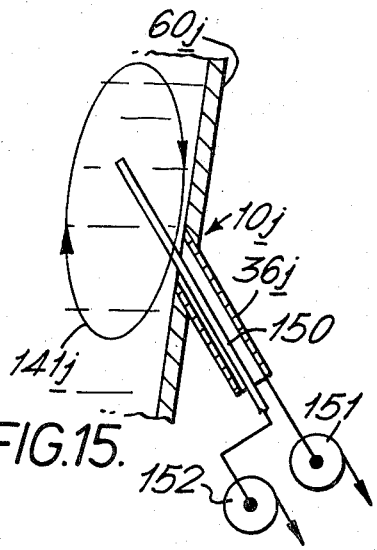
FIG.15.
FIG.17.
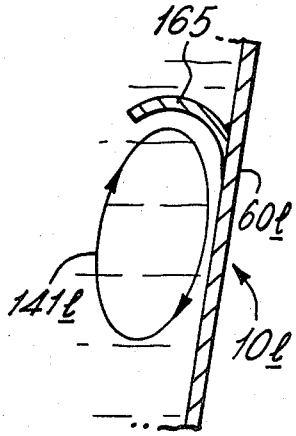

CONTAINMENT OF PRESSURIZED FLUID JETS

BACKGROUND TO THE INVENTION

This invention relates to the containment of pressurized fluid jets, primarily high pressure, (e.g. 1000 lbs per square inch and above), fluid jets, and is particularly, (but not exclusively), concerned with the containment of upwardly-discharging oil jets, resulting from "blow-outs" at oil rigs.

Oil blow-outs can result in substantial pollution as well as a large loss of revenue.

The invention has, however, applications other than containing high pressure jets, for example:

(a) the collection of oil and/or gas from a drilling rig, (b) the exchange of heat and/or pressure, (c) the separation of liquids of various densities from a mixture of the same, and (d) the containment of low (e.g. less than 1000 lbs per square inch) pressure fluid jets.

As used herein, the term "containing" includes absorbing energy from the fluid jet, and the term "oil" includes mixtures of oil, liquids and gases.

Furthermore, as used herein, the term "liquid" includes water, oil and semi-solids, such as mud.

SUMMARIES OF THE INVENTION

According to one aspect of the present invention, a method of containing a pressurized fluid jet comprises disposing a body of liquid in the path of said jet whereby sufficient energy is absorbed by movement of the liquid to contain the jet.

According to another aspect of the present invention, apparatus for containing a pressurized fluid jet comprises a receptacle for holding a body of liquid, and means whereby the jet can enter the receptacle, the arrangement being such that, with said body of liquid in the receptacle, sufficient energy is absorbed by movement of liquid to contain the jet.

The receptacle is preferably of generally conical form, for example, of frusto-conical form.

BRIEF DESCRIPTION OF THE DRAWINGS

The various aspects of the invention will now be described, by way of example only, with reference to the accompanying semi-diagrammatic drawings, wherein:

FIG. 1 is a side view, partly in medial section, of the upper part of an oil rig, with apparatus according to the invention disposed thereon, FIG. 2 is a detail, to an enlarged scale, of part of FIG. 1, FIG. 5 is a view, similar to that shown by FIG. 3, and illustrates one modification, FIG. 6 is a side view, in medial section, illustrating a modified containment tank, FIG. 10 is a side view, in medial section, which illustrates how control can be applied to containment apparatus, FIGS. 11, 12 and 13 are side views, in medial section, of tank filling and heat/pressure exchange apparatus, and FIGS. 14 to 17 are fragmentary side views, in medial section, which illustrate various modifications.

In the figures, like reference numerals refer to like components.

DETAILED DESCRIPTION OF THE PREFERRED EMBODIMENTS

Figure 4:
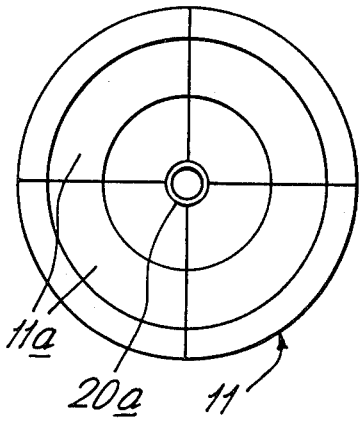
FIG. 4 is a plan view which illustrates a modification.

With reference to FIG. 1, an off-shore oil rig 1 for the production of oil includes a well-head platform 2 and an oil discharge pipe 3. A conventional manifold assembly with control/isolating valves whereby oil is directed to several receiving stations, plus other components, would normally be connected to the upper end of pipe 3 but have been omitted from FIG. 1 for reasons of clarity.

The platform 2 supports apparatus 10 for containing a jet of high pressure oil should it escape upwardly from the pipe 3.

The apparatus 10 comprises a receptacle in the form of a tank 11 for holding a body of water 12, the arrangement being such that, as explained hereinafter, the escaping jet can enter the tank 11 from below, whereby sufficient energy is absorbed by jet-induced movement of the water to contain the jet.

The tank 11 is of frusto-conical form with the small end lowermost, i.e. nearest to pipe 3. The tank 11 is supported above the platform 2 by four equi-spaced legs 13. The bottom of the tank 11 is perforated by a centrally-disposed aperture 14 aligned with pipe 3 and closed by a non-return flap valve 15. (The valve 15 is shown in dotted lines).

A tubular structure 20 is disposed centrally within the tank 11, in an upright position. The bore of the structure 20 is of somewhat larger diameter than that of the aperture 14. The upper end of the tubular structure 20 is slidably located by a tubular guide 21 carried by the central part of a baffle 23, the periphery of which is attached to the wall of the tank 11. The baffle 23, which is of frusto-conical form, is perforated by holes 24.

A second baffle 30, also of frusto-conical form, is disposed in the tank 11, with its lower periphery attached to the wall thereof. The baffle 30, which is perforated by holes 25, has a central aperture 31, the periphery of which is spaced from the tubular structure 20. The lower end of the tubular structure 20 is open and the upper end thereof is closed by a blank 32.

Ducts 36, 37, 38 disposed at differing heights connect the tank 11 with valved outlets, (not shown), operable from positions remote from the well-head.

As shown in FIG. 2, the lower end of the tubular structure 20 rests on a flanged ring 40. The periphery of the flap valve 15 is clamped to the bottom of the tank 11 by the flange of the ring 40.

A tubular seal 41 extends between the bottom end of the tubular structure 20 and the ring 40, so as to cover the junction therebetween and prevent the escape of water. The ends of tubular seal 41, which is of easily frangible material, such as fabric, are secured to the structure 20 and ring 40 by "pipe-clips" 42, 43.

The flap valve 15 is of "multi-segment" form, with the segments coming together at the centre, in the convergent manner shown in FIG. 2.

Figure 3:
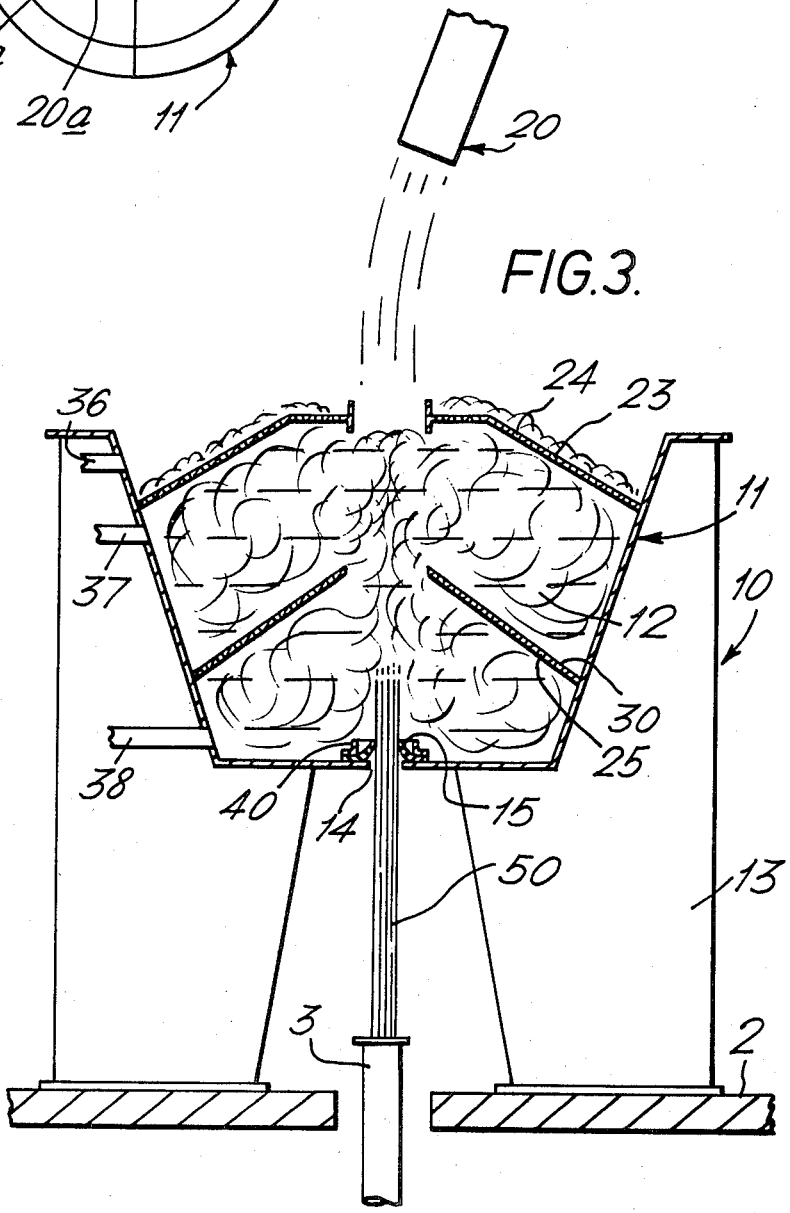
FIG. 3 is a view similar to that shown by FIG. 1, and illustrates the apparatus in operation.

With additional reference now to FIG. 3, assuming the occurrence of a blow-out, caused, for example, by trouble arising from the need to overhaul the manifold assembly at the upper end of oil pipe 3, a high pressure oil jet 50 will discharge upwardly from the pipe 3.

The oil jet 50 will then enter the tank 11 by way of the aperture 14, deflecting the segments of the valve 15 outwardly as it does so, to pass through the bore of the tubular structure 20 until it contacts the blank 32.

Initially, the tubular structure 20 serves as a barrier means to isolate the body of water 12 from the oil jet 50. However, pressure of the oil jet 50 on the under-surface of the blank 32 ejects the tubular structure 20 clear of the tank 11, breaking the frangible seal 41 as it does so. Removal of the barrier provided by the structure 20 results in the body of water 12 being disposed in the path of the oil jet 50 whereby energy is absorbed, by movement of the water, due to entrainment and the generation of vortices, caused by the jet, within the confines of the tank 11. Sufficient energy is absorbed by movement of the water 12 to contain the jet and thus prevent the loss of oil (and water 12) from the tank 11.

The void left by the structure 20 as it rises out of the tank 11 needs to be filled very quickly with water 12. Otherwise, the oil jet 50 will pass through the tank, entraining water with it, so as to empty the tank in a very short time. The system of ejection described above results in the structure 20 being expelled at a sufficiently high speed to prevent such entrainment.

As soon as the oil jet 50 enters the body of water 12, the valved outlets of one or more of the ducts 36, 37, 38 are opened so as to prevent the tank 11 from overflowing. Water 12 in the tank 11 is very quickly replaced by oil from the jet 50 and oil flowing from the tank 11 can be fed into storage tanks, or into tankers, until such time as the escape of oil is stopped.

Ducts 36, 37 serve as overflow ducts, and maintain a substantially constant volume of liquid in the tank 11.

The body of liquid within the tank 11 "captures" and contains the oil jet 50 to such an extent that the level of liquid merely rises at the centre to form a hump. The baffle 23 serves to "cap" the hump and confine it, whilst the perforations 24 in the baffle allow gas to escape from the tank 11. The baffle 30 serves to reduce any tendency for the entrainment action to set up unwanted vortices, which would (in this case), lead to loss of liquid from the tank 11.

In fact, use of the baffle 30 is only required in the case of a tank of large volume, where a correspondingly large mass of liquid is used to absorb energy from a jet. Where smaller volume tanks are employed, the use of vortices is encouraged.

Curtailment and capture of the jet 50 avoids pollution and loss of revenue-earning oil, and allow repair personnel to gain access to the well-head.

The invention achieves the above without risk of fire.

Tests conducted indicate that a tank with lower side parts which slope inwardly in a downward (confining) direction is preferable, otherwise the inflowing oil jet 50 will tend to expel liquid from the tank. The plan form of the tank is not critical. The plan form of the tank 11 illustrated is circular but other plan forms, for example, rectangular, may be used.

It will be appreciated that the arrangement shown in FIGS. 1, 2 and 3 is not to scale. Actually, in the present example, the pipe 3 would have a diameter of about 4 inches; the tank 11 would have an upper diameter of about 30 ft., a lower diameter of about 20 ft., and a depth of about 10 ft., and the bottom of the tank 11 would be disposed about 10 ft. above the platform 2. The bore of tubular structure 20 would be about 2 ft. in diameter. Obviously, however, dimensions may vary according to requirements.

The valve 15 is formed so that the segments of the valve are held open by the incoming jet 50 to such an extent that oil can enter the tank 11 without significant escape of liquid therefrom.

The tank 11 can be permanently or semi-permanently installed, or, with reference to FIG. 4, it may be made in four or more cooperating segment-like sections 11*a*, each with a segment of tubular structure 20*a* and suitable water seals. The tank can then be assembled after a blow-out has occurred. However, such assembly could be dangerous and a semi-permanent or permanent installation is preferred.

A permanent installation may also be used full-time for oil-collection purposes, so dispensing with the usual manifold assembly at the well-head. Under such conditions there is, in effect, a permanent "blow-out".

Oil or other liquids, including mud, may be used instead of the water 12.

The apparatus 10 can be of inexpensive construction. For example, G.R.P. (Glass-reinforced plastics material) can be used for the tank 11 and tubular structure 20. All the tank 11 has to do is to contain a sufficient volume of liquid. It is not subjected to any significant dynamic loading.

Instead of the system of ejection described above, high speed (remote-controlled) actuator means may be used to lift the tubular structure 20 to a sufficient height whereby it does not interfere with "capture" of the oil jet 50 by the body of liquid in tank 11.

The tank 11 is formed so as to contain a sufficient volume of liquid, (water, oil etc.), whereby sufficient energy is absorbed, by movement of the liquid, to prevent an oil jet breaking through the free surface of the liquid to any great extent.

In addition to the ducts 36, 37, 38, one or more outlets may be provided whereby any solids or semi-solids entering the tank 11 by way of the oil jet 50 can be removed.

The collection of gas, for example, following a "blow-out" may well be as important as the preventage of spillage of oil and FIG. 5 illustrates modified apparatus suitable for this purpose.

With reference to FIG. 5, a modified apparatus 10*a* is provided wherein tank 11*a* is basically the same as tank 11 of FIG. 3 but is provided with a cylindrical extension (51) of its wall. The upper end of extension 51 is formed with a bell mouth.

Apparatus 10*a*, which can collect oil as well as gas, has a cap 52 which is lowered into place after the component equivalent to structure 20 (FIG. 1) has been ejected, so that it is slidably disposed within the cylindrical extension 51. The cap 52, which is preferably of plastics material, in order to avoid causing sparks, and because it is expected to be subjected only to very low working pressures, has a domed upper end portion and a cylindrical skirt portion. A weight 57 of annular form is attached to the lower periphery of the skirt portion.

The domed upper end portion of cap 52, which cap serves as a non-stationary cover for tank 11*a*, is provided with a vent duct 53 providing for release of gas to atmosphere. A free space 59 for gas separated out by the apparatus exists above the body of liquid 12*a*. A valve 54 is fitted in the vent duct 53 so as to control the escape of gas therethrough. At least one duct 55 extends through the side of tank 11*a* to pass upwardly through the liquid 12*a* and terminate in the free space 59. The duct 55, which is provided with an external control valve 58, provides a downward escape path for gas from free space 59 when valve 58 is open and valve 54 closed. Gas removed from free space 59 can then be collected at the outlet end of duct 55.

The domed upper end of cap 52 carries a gas pressure relief valve 56. Ducts 36*a*, 37*a* and 38*a* allow for the collection, respectively, of oil, water and sludge.

The cap 52 and extension 51 cooperate, with a telescopic relationship, in a similar manner to that of a town gas-holder. In order to maintain a seal around the base of the cap, it is necessary to allow the liquid in the tank to be at a higher level than that shown in FIG. 1.

For a permanent, i.e. full-time, collection installation, the tank 11*a* may be attached directly to the upper end of pipe 3, using an extension of pipe 3, so as to minimise the escape of oil.

The body of liquid required to contain a high pressure fluid jet may be substantially reduced in volume by making the receptacle for containing the liquid of generally triangular (vertical) cross-section. One such receptacle comprises the generally conical tank 60 shown in FIG. 6.

With reference to FIG. 6, the tank 60 of apparatus 10*b* is actually of frusto-conical form with wall parts defining an included angle, in side elevation, of (preferably) less than 25°. Fluid from pipe 3 enters the tank at the smaller end of the tank 60.

In one particular experiment, a conical tank of circular cross-section with wall parts defining an included angle of 10° effectively contained a water jet of 60 lbs per square inch gauge without internal baffles and with little evidence of any "hump" in the free liquid surface.

A typical full-scale installation based on this experiment would result in a conical tank having an upper diameter of about 3.5 ft. and a height of 16 ft.

Other tank shapes have also been found to be effective. For example, tanks of rectangular plan form with sloping wall parts giving the tank a triangular (vertical) cross section. Small scale tests with tanks having sloping wall parts so that they have triangular vertical cross-section, show that intense vortices generated in the liquid by entry of the pressurized jet act to extract the energy from the jet. These vortices cause effective mixing of the emerging jet and the surrounding liquid. The tanks may have circular or rectangular plan form; the sloping side parts are more important. Indications are that a small lateral gap may be required between the internal surface of the tank at its base and the jet at that point.

A fluid jet contained by the use of a tank of triangular cross-section may be released by creating an air leakage path into the base of the cone in the vicinity of the entering jet. Containment of the jet can then be reachieved by allowing liquid to enter the tank in a rapid manner, for example, by way of control ports.

Figure 8:
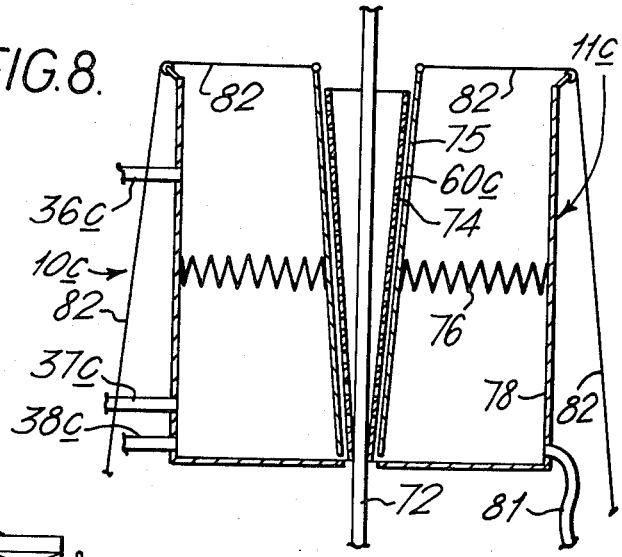
FIG. 8 is a detail, to an enlarged scale, of part of FIG. 7.
Figure 7:
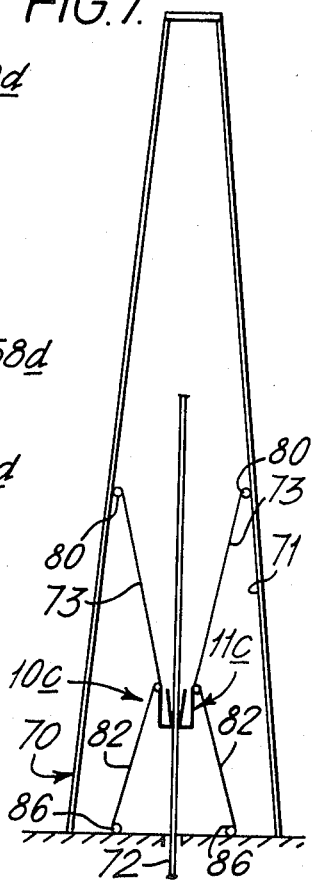
FIG. 7 is a side view and illustrates another modification.

FIGS. 7 and 8 illustrate apparatus 10*c* whereby control ports are used to introduce a body of liquid so as to contain a fluid jet. The figures show an oil drilling rig 70 provided with a G.R.P. tank 60*c* of frusto-conical form. The wall of the tank 60*c* is extensively perforated and forms part of a tank assembly 11*c*, suspended, by cables 73, from the structure of the drilling derrick 71 so as to encircle the drilling pipe 72. The perforations in the wall of tank 60*c* form control ports 74 which can be covered by barrier means comprising a conical sleeve 75 comprising two (or more) cooperating parts with unperforated walls. As shown in FIG. 8, the two cooperating parts of the sleeve 75 are normally held against the receptacle 60*c*, (so as to cover ports 74), by means of compression springs 76. A cylindrical tank 78 of considerably greater internal volume than that provided by frusto-conical tank 60*c* is disposed co-axially around tank 60*c* and is attached rigidly thereto. Sleeve parts 75 can be moved away from tank 60*c* by cables 82, the effective lengths of which can be shortened by use of winches 86 (FIG. 7). The tank assembly 11*c* is movable, up or down, relative to the drilling pipe 72, by means of cables 73 and winches 80 (FIG. 7). Collection pipes 36*c*, 37*c* and 38*c* are of flexible construction so as not to hinder this movement of tank assembly 11*c*.

In operation, should a blow-out occur on the drilling pipe 72 and above the tank assembly 11*c*, it is necessary to raise the tank assembly so as to position it appropriately in relation to the blow-out point. The outer tank 78 is then quickly filled with liquid. In this example water is supplied to the outer tank 78 by way of a flexible hose 81. The control ports 74 in tank 60*c* are then opened quickly by rapid winching in of the cables 82 (using winches 86) against the action of springs 76. The hitherto isolated water then rushes into the inner tank 60*c* by way of ports 74, so as to flood the tank whereby the escaping oil is contained by the generation of vortices in the body of water. Any gas present can escape to atmosphere by bubbling through the body of water.

At the expense of further complication, the gas-collection method described above with reference to FIG. 5 may also be applied to the arrangement illustrated by FIGS. 7 and 8. Alternatively, the semi-permanent multipart arrangement referred to in respect of FIG. 4 may be applied to the arrangement of FIGS. 7 and 8. Since the size of the components and the weight and volume of liquid can be drastically reduced by using the teachings of FIGS. 6, 7 and 8, the embodiment illustrated thereby becomes more practicable and is therefore to be preferred.

Figure 9:
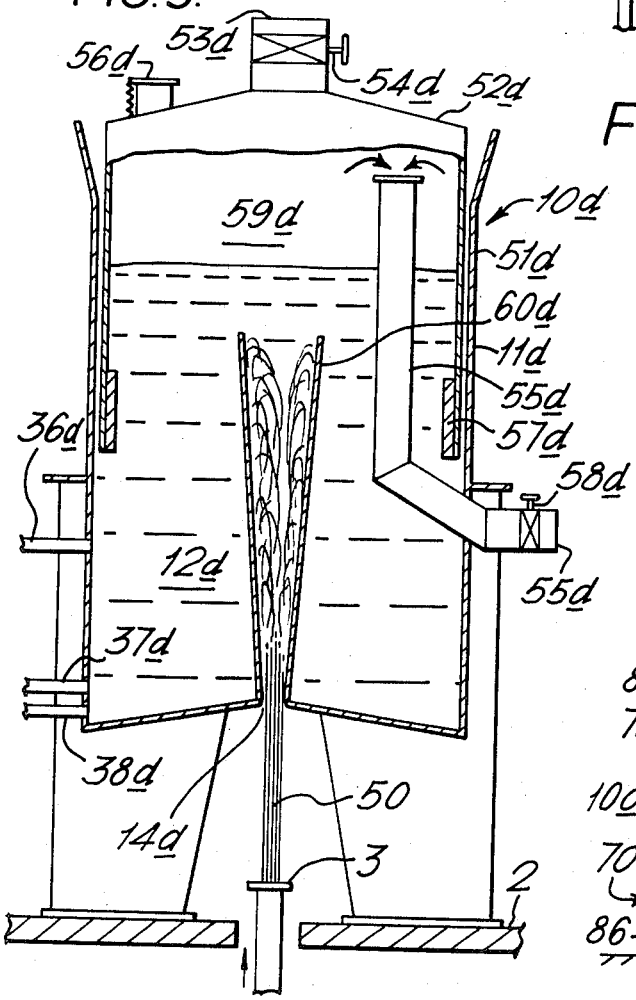
FIG. 9 is a side view similar to that shown by FIG. 5, and illustrates a further modification.

The arrangement shown by FIG. 5 may be modified to take advantage of the more effective containment method of FIG. 6. Such a modification is shown in apparatus 10*d* of FIG. 9 wherein the frusto-conical tank 60*d* thereof is contained permanently within a generally cylindrical tank 11*d* of substantially larger volume. The tank 11*d* is provided with a dished lower end to assist the collection of water and sludge.

In operation, violent mixing of the components of the jet in the inner tank 60*d* will ensure that grit, water and mud, as well as oil, will flow over the lip of the inner tank into the annular space between the inner and outer tanks 60*d*, 11*d*. Since the internal pressure of the tank 11*d* will only be atmospheric or slightly above, the contents of tank 11*d* will be relatively undisturbed. The components of the jet may thus be drawn off at appropriate (predetermined) levels, using ducts 36*d*, 37*d*, 38*d*. The separated fluids can then be conducted to suitable storage tanks.

If containment of the jet 50 by tank 60*d* becomes temporarily ineffective, resulting, for example, from passage of a slug of solid (or semi-solid) material or bubble of gas passing through tank 60*d*, the large volume body 12*d* of liquid in the annular space between tanks 60*d* and 11*d* is available to re-instate the attentuation system by spilling over into the inner tank 60*d*.

In some installations it may be advantageous to arrange for the frusto-conical tank to be upside down, horizontal or at any other angle. Any gas present can be collected in a similar manner to that shown in FIG. 5.

A lightweight receptacle of frusto-conical form can be attached to the outlet end of any pipe being supplied with fluid at a high pressure.

FIG. 10 shows apparatus 10*e* with such a receptacle (60*e*) attached to the end of a flexible water hose 90. When "full", sufficient energy is absorbed, by the generation of vortices within the conical receptacle 60*e*, to allow water to escape only at low velocity and at substantially atmospheric pressure from the outlet end of the receptacle. Under these conditions there is virtually no thrust, i.e. reactive force, on the hose 90 due to the high speed jet. The apparatus 10*e* may be converted rapidly to allow an unrestrained release of water by allowing air to enter the inlet, i.e. smaller end of the receptacle 60*e*, using a valved pipe 92. Introducing air in this way also has the effect of reintroducing a reactive force on the hose 90.

The receptacle 60*e* may be reprimed either by using an arrangement employing a sleeve and control port system, as described above with reference to FIGS. 7 and 8, or by temporarily inserting an obdurating member of spoiler 91 (here of perforated form) into the mouth of the receptacle 60*e* so as to divert water against the inner surface of the receptacle. As soon as the receptacle 60*e* has been re-primed, the spoiler 91 may be removed.

A small-scale experimental apparatus 10*e* had a hose 90 of 0.0625" bore, supplied with water at 60 lbs per square inch gauge. The receptacle 60*e*, which was 3.0 inches in length and of 0.625 inch diameter at the larger end, provided adequate containment of the water jet.

With reference to FIG. 11, a generally conical receptacle 60*f* is shown disposed within a tank 100 being filled with liquid through a high pressure duct or hose 90*f*, so as to enter the tank 100 at low velocity, as in the case with apparatus 10*e* of FIG. 10. Liquid thus enters tank 100 without disturbing sediment or causing aeration of the tank contents. The receptacle 60*f* is connected to the outlet of the hose 90*f* so that liquid, (for example, oil), enters the tank by way of the receptacle. In this case a perforated spoiler 91*f* may be permanently disposed in the outlet end of receptacle 60*f*, so as to retain liquid therein and thus continue to absorb energy by the generation of vortices, even when the liquid 101 in the tank 100 is at a low level.

It will be noted from FIG. 11 that the receptacle 60*f* can be disposed substantially horizontally.

The teachings of the present invention may also be employed in order to provide for the exchange of heat and/or pressure.

Figure 12:
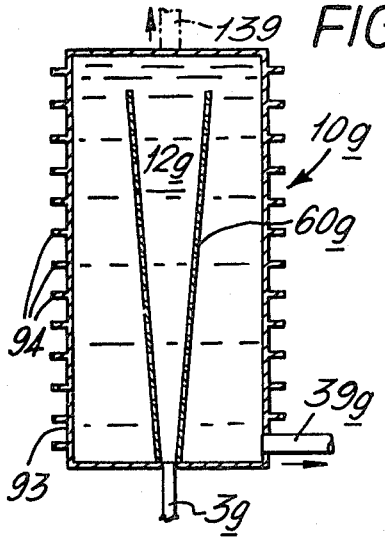

FIG. 12 illustrates heat exchange means comprising apparatus 10*g* wherein a perforated receptacle 60*g* of frusto-conical form is used to cool a hot fluid supplied to the smaller end of the receptacle by way of pipe 3*g*. The receptacle 60*g* is housed within a chamber 93 provided with external heat exchange fins 94. The receptacle 60*g* and chamber 93 together define an annular space for holding the major part of the body of liquid 12*g*.

In operation, with a body of liquid 12*g* already present in receptacle 60*g* and chamber 93, pressurized fluid enters the heat exchange apparatus via pipe 3*g* to give up its heat to chamber 93 and the fins 94 thereof. The generation of vortices in the liquid 12*g* by entry of the pressurized fluid contributes substantially to the exchange of heat. The reduced-temperature fluid is conducted away from the apparatus by way of outlet 39*g*. The chamber 93 may be of closed form, i.e. as illustrated, whereby it is subject to an internal pressure, or it may be provided with a header vent whereby it operates at a lower pressure, which may be atmospheric. The apparatus then serves as a pressure reducing means as well as a heat exchanger. A suitable header vent 139 is shown in dotted lines.

Figure 13:
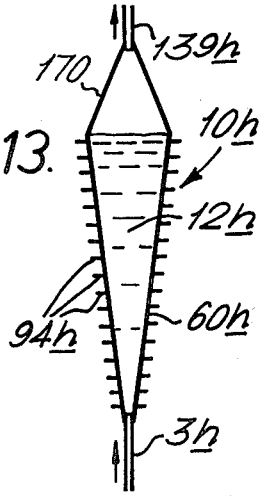

FIG. 13 illustrates an alternative form of heat exchange/pressure reducing means comprising apparatus 10*h*. With reference to FIG. 13, external cooling fins 94*h* are attached directly to the body of the frusto-conical tank 60*h*. Fluid enters the tank 60*h* via pipe 3*h* at relatively high velocity and leaves via conical tank cover 170 and pipe 139*h* at relatively low velocity. The intense mixing which takes place within the frusto-conical tank 60*h* due to the generation of vortices ensures that the fluid makes intimate contact with the sides of the tank, so as to ensure efficient cooling as well as a substantial reduction in the pressure difference between the supply and draw-off pipes 3*h*, 139*h*.

FIG. 14 illustrates part of an oil drilling rig wherein apparatus 10*i* including a tank 60*i* of frusto-conical form, is disposed around a drilling pipe 72*i*. A tubular sheath 140 is disposed co-axially about the pipe 72*i* so as to define an annular passageway for the upward flow of a jet 50*i* of pressurized oil, mud etc., released by drilling and/or blow-out.

The annular jet 50*i* streams upwardly along the drilling pipe 72*i* as it enters the tank 60*i* to mix with the body of liquid 12*i* contained therein. As the annular jet 50*i* mixes with the liquid 12*i*, it gives up energy in generating vortices, represented in FIG. 14 by primary and secondry vortices 141, 142.

Duct 36*i* is disposed so that vortex 141 is "tapped" whereby liquid is separated out dynamically.

Means may be provided to retard unwanted swirl which might build up sufficiently to carry the liquid 12*i* out of the tank 60*i*. Such means may comprise internal plates 143, 144 attached to the wall of the tank 60*i* and disposed substantially parallel to the longitudinal axis thereof.

FIG. 15 shows how liquids of various densities can be separated out dynamically of a mixture by use of apparatus 10*j*. Duct 36*j* is used to collect liquid of one density present adjacent a vortex 141*j* and an inner, co-axially disposed inner duct 150 is used to collect liquid of a differing density present in a central part of the same vortex. Suction pumps 151, 152 can be employed if extraction is necessary or desirable.

In all the above-described examples, the fluid jet was shown to enter a central part of the liquid-containing receptacle. This is not necessary, however, as is illustrated by FIG. 16.

FIG. 16 shows apparatus 10*k* which makes use of a tank 60*k*. The tank has a substantially rectangular cross-section when viewed end-on, (as is shown by FIG. 16), but has a substantially triangular shape with "apex" lowermost, when viewed side-on. (As viewed in the direction of arrow 160).

Pressurized fluid enters the lower end of tank 60*k* by way of duct 3*k* which is disposed adjacent the back wall of the tank. Thus fluid entering the tank 60*k* tends to stream along the back wall before breaking away to form the vortex 141*k*. The behaviour of the fluid is similar to that in apparatus 10*i* illustrated by FIG. 14, wherein fluid entering the tank 60*i* tends to stream upwardly along drilling pipe 72*i*.

With this in mind, it may be desirable to provide some of the above-described embodiments with internal plates or other surfaces along which incoming fluid can attach itself.

In a non-illustrated modification of the arrangement shown in FIG. 16, the tank 60*k* has a substantially rectangular shape when viewed in the direction of arrow 160.

Means may be provided to further encourage or promote the formation of a vortex. With reference to FIG. 17, which illustrates apparatus 10*l*, such means may comprise internal plates 165 which define concavities serving as guide surfaces.

Structures smaller than plates 165 may be sufficient to enhance or initiate the formation of vortices.

Where suitable, any of the above-described arrangements may be substituted and/or combined. For example, the plates 165 of FIG. 17 could be disposed in the tank 60*i* of FIG. 14.

Inter alia, the invention has the beneficial effect of greatly reducing the noise emanating from an uncontrolled jet of fluid.

I claim:

1. Apparatus for containing a pressurized fluid jet, comprising a receptacle of generally conical form for holding a body of liquid, the receptacle having walls defining an included angle of less then 25°, non-return valve means disposed at the small end of the receptacle, and means for directing the fluid jet through the valve means into the receptacle, having a discharge outlet, of smaller dimension than the valve means, spaced from the valve means, vortices generated in the body of the liquid absorbing energy from and containing the fluid jet.

2. Apparatus as claimed in claim 1, provided with barrier means for isolating the body of liquid from the jet and means for removing said barrier means, so as to allow contact between the body of liquid and the jet.

3. Apparatus as claimed in claim 2, wherein the receptacle is disposed within a tank so as to define an annular space therewith for holding the body of liquid, the receptacle being provided with ports whereby the receptacle can be flooded by entry of liquid through the ports, and said barrier means are disposed so as to removably cover said ports.

4. Apparatus as claimed in claim 1, for use in containing a pressurized jet comprising fluid in both the liquid and gaseous phase and provided with means for collecting gaseous fluid separated out in said receptacle.

5. Apparatus as claimed in claim 1, wherein the receptacle is perforated and wherein the receptacle is disposed in a chamber so as to define therewith an annular space for holding part of said body of liquid.

6. Apparatus as claimed in claim 1, provided with means for retarding swirl in the receptacle.

7. Apparatus as claimed in claim 1, provided with means for further encouraging movement of liquid within the receptacle.

8. Apparatus as claimed in claim 1, provided with means for separating out fractions of said liquid.

9. The combination of an oil-rig and apparatus as claimed in claim 1.

10. The combination of an oil drilling rig and apparatus as claimed in claim 1.

11. Apparatus as claimed in claim 1, wherein the receptacle is disposed in a tank provided with a duct for filling the tank with liquid, the receptacle being connected to the duct outlet so that liquid enters the tank by way of the receptacle.

12. Heat exchange means comprising apparatus as claimed in claim 1, and operable so as to reduce the temperature of the jet fluid.

13. Pressure-reducing means comprising apparatus as claimed in claim 1, and operable so as to reduce the pressure of jet fluid.

14. Apparatus for containing a pressurized fluid jet, comprising a receptacle of generally conical form, having walls defining an included angle of less then 25°, a body of liquid disposed in the receptacle, non-return valve means for introducing the jet disposed at the small end of the receptacle, and means for directing the fluid jet through the valve means, having a discharge outlet, of smaller dimension than the valve means, spaced from the valve means, vortices generated in the body of liquid absorbing energy from and containing the fluid jet.

15. Apparatus for containing a pressurized fluid jet, comprising a tank, a receptacle of generally conical form, having walls defining an included angle of less than 25°, disposed within the tank so as to define an annular space therewith, non-return valve means for introducing the jet disposed at the small end of the receptacle, a first body of liquid disposed in the receptacle, means for directing the fluid jet through the valve means, having a discharge outlet, of smaller dimension than the valve means, spaced from the valve means, a second body of liquid disposed in said annular space, cap means for covering the tank, means for collecting any gaseous fluid disposed beneath said cap means, and tank outlet means for separating out fractions of said second body of liquid, vortices generated in the first body of liquid absorbing energy of and containing the fluid jet.

16. A method for containing a fluid jet, comprising the steps of: sealingly disposing a body of liquid in the path of said jet, the liquid being held in a receptacle having walls defining an included angle of less than 25°, directing the jet into the smaller end of the body of liquid, while preventing flow of ambient fluid into the body of liquid with the jet, and absorbing sufficient energy of the jet by generating vortices in said body of liquid to contain the jet.

17. The method of claim 16, wherein the fluid is in both the liquid and gaseous phase and means for provided for separating out and collecting at least one of the phases.

18. The method of claim 16, wherein the included angle is substantially 12°.

* * * * *